US006146293A

United States Patent [19]

Chinn et al.

[11] Patent Number: 6,146,293

[45] **Date of Patent: *Nov. 14, 2000**

[54] HOCKEY PUCK HAVING SELF-LEVELING MEANS

[75] Inventors: Kevin S. Chinn, Skokie, Ill.; Richard A. Haack, 5356 N. Luna, Chicago, Ill. 60630

[73] Assignees: Kevin Chinn; Richard A. Haack, both of Skokie, Ill.

[ * ] Notice: Under 35 U.S.C. 154(b), the term of this patent shall be extended for 712 days.

[21] Appl. No.: 08/677,776

[22] Filed: Jul. 10, 1996

Related U.S. Application Data

[63] Continuation of application No. 08/399,191, Mar. 6, 1995, abandoned.

[51] Int. Cl.[7] ..... A63B 71/00

[52] U.S. Cl. ..... 473/588

[58] Field of Search ..... 273/126, 128, 273/57.2; 473/588, 589, 587

[56] References Cited

U.S. PATENT DOCUMENTS

| | | | |
|---|---|---|---|
| 2,226,516 | 12/1940 | Ross . | |
| 2,467,043 | 4/1949 | Kotler . | |
| 3,092,389 | 6/1963 | Smith . | |
| 4,000,900 | 1/1977 | Lehmann . | |
| 4,078,801 | 3/1978 | White, Sr. . | |
| 4,153,253 | 5/1979 | White, Sr. . | |
| 4,801,144 | 1/1989 | De Masi, Jr. et al. . | |
| 5,199,708 | 4/1993 | Lucas . | |
| 5,269,520 | 12/1993 | Vellines | 273/128 R |
| 5,284,343 | 2/1994 | Bigornia et al. . | |
| 5,288,072 | 2/1994 | Hsieh | 273/128 R |

OTHER PUBLICATIONS

Advertisement for "hot pucks" by Sun Hockey, Inc., *Windy City Sports,* Feb., 1995.

Advertisement for Franklin Active Gravity System puck, NIHA Hockey Talk, Issue 2, vol. 2, Jul. 1995.

*Primary Examiner*—Raleigh W. Chiu
*Attorney, Agent, or Firm*—McDonnell Boehnen Hukbert & Berghoff; Steven J. Sarussi

[57] ABSTRACT

A hockey puck having a cavity and a self leveling weight disposed therein for causing the puck to topple from its side to a face when rolling and for maintaining a face of the puck substantially parallel to the playing surface.

16 Claims, 2 Drawing Sheets

HOCKEY PUCK HAVING SELF-LEVELING MEANS

This application is a continuation, of application Ser. No. 08/399,191, filed Mar. 6, 1995 now abandoned.

BACKGROUND OF THE INVENTION

1. Field of the Invention

This invention relates to the field of hockey pucks and, more specifically, to hockey pucks designed to be resistant to rising up on an edge of the puck and thus, to decrease rolling of the Puck.

2. Description of the Related Art

Street hockey is played similarly to ice hockey, but can be played on convenient hard surfaces like play grounds, parking lots, roads and the like. Many who play street hockey also play ice hockey or at least follow the latter sport. Thus, it is important that a street hockey puck respond much like an ice hockey puck does when it is passed or shot, or in interaction with sticks and the playing surface.

Heretofore, a standard or official hockey puck was made of solid rubber of desired diameter, thickness, weight, and resiliency in the form of a round disc, with the top and bottom surfaces parallel, and with the flat edge portion perpendicular thereto.

During play, such a standard puck is very apt to rise up on an edge such that the top and bottom surfaces are substantially perpendicular to the playing surface, whereby the puck rolls on its edge. Due to greater friction between the puck and rougher playing surfaces, rolling of the puck is generally more frequent and prolonged on those surfaces. This is a highly objectionable feature, as a rolling puck cannot be readily controlled, passed or shot by a player, as the puck must lie substantially flat on either of its disc-like surfaces to facilitate stick-handling, passing, and shooting.

This problem was addressed by the hockey puck described in U.S. Pat. No. 2,226,516. The hockey puck described in that patent includes an edge that is chamfered or rounded. This feature is said to cause the puck to tend to automatically fall on either of the faces of the puck.

SUMMARY OF THE INVENTION

The present invention is directed to a hockey puck designed to obviate the difficulties outlined above, i.e., to largely eliminate the tendency of the puck to rise up onto its edge and roll and to cause the puck, when rolling, to tend to fall quickly on either of its flat disc surfaces The improved hockey puck of the invention thus substantially eliminates the difficulties incident to a puck rolling for any substantial length or distance on its edge.

Accordingly, the invention encompasses a hockey puck comprising a cylindrical body having a side, an upper face and a lower faces the faces being substantially perpendicular to the side. The side and the upper and lower faces define a cavity having a means disposed therein for (1) causing the puck to topple from the side, and/or (2) maintaining a face of the puck substantially parallel to the playing surface.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION OF THE PREFERRED EMBODIMENT

A hockey puck according to the invention preferably has the same external dimensions as a standard, official, hockey puck, i.e., about 76 mm (3 inches) by 25 mm (1 inch). However, the inventive hockey puck can be made in any size desirable. The external shape of the hockey puck is substantially similar to that of a conventional ice hockey puck, though variations in the corner design are within the scope of the invention.

A hockey puck according to the invention preferably is of a weight similar to that of a conventional ice hockey puck, i.e., about 170 g or 6 ounces. However, the hockey puck of the invention can be manufactured such that it is more or less heavy than a conventional puck.

Figure 1:
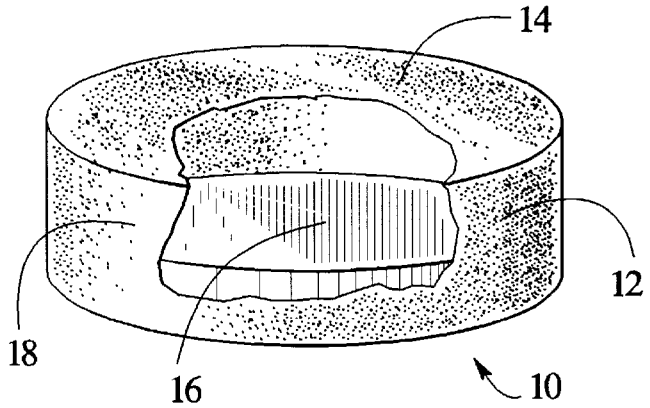
FIG. 1 is a perspective view of a hockey puck in accordance with the invention, having a portion of the puck cut away.
Figure 2:
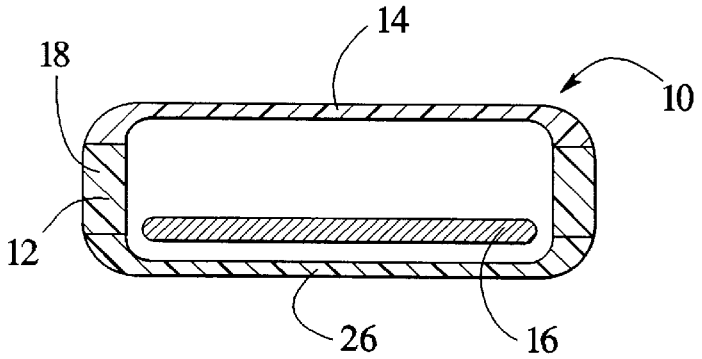
FIG. 2 is a sectional view of a three-piece hockey puck having rounded corners according to the invention.

As seen in FIGS. 1 and 2, a hockey puck 10 according to the invention includes a generally cylindrical body 12 formed from any substantially moldable material, including an upper face 14, a lower face 26, and a cylindrical side 18 which is substantially perpendicular to the faces 14 and 26. Suitable materials include polymeric materials such as polyurethane or other moldable plastics of similar hardness, synthetic or naturally occurring rubber, such as nitrile rubber, polypropylene or styrene-butadiene. Other suitable materials are thermoplastic materials such as a high density polyethylene, polyvinyl chloride, ultra high molecular weight polyethylene, and polycarbonate.

Figure 3:
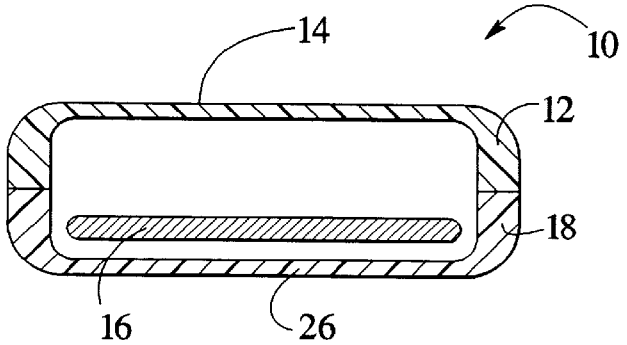
FIG. 3 is a sectional view of a two-piece hockey puck having rounded corners according to the invention.

Upper face 14 and lower face 26 may be made of the same material as generally cylindrical body 12, but each of the faces 14 and 26 may also be made of different materials. The corners formed by faces 14 and 26 and side 18 may be square as shown in FIG. 1, or, preferably, these corners may be chamfered (FIGS. 4 and 5) or rounded (FIGS. 2 and 3).

The thickness of side 18 may be the same or different from the thickness of upper face 14 and lower face 26. The thickness of each of these parts can range from about 1 mm to about 10 mm. The side 18, upper face 14 and lower face 26 define a cavity suitable for containing a means for causing the puck to topple from the side and for maintaining a face of the puck substantially parallel to the playing surface.

Figure 4:
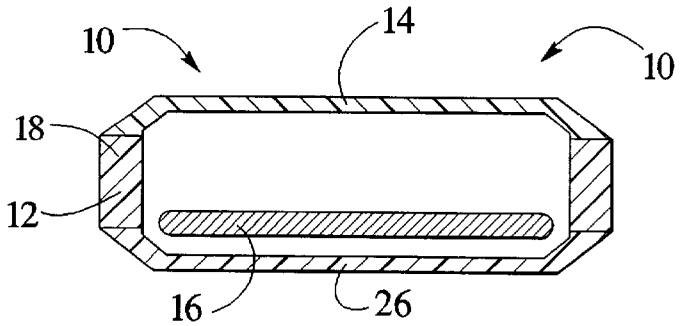
FIG. 4 is a sectional view of a three-piece hockey puck having chamfered corners according to the invention.
Figure 5:
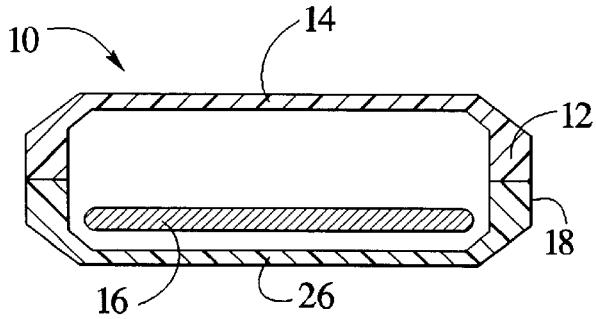
FIG. 5 is a sectional view of a two-piece hockey puck having chamfered corners according to the invention.

Hockey puck 10 may be formed from one, two, three or more pieces of similar or dissimilar materials. FIGS. 2 and 4 illustrate three-piece embodiments while FIGS. 3 and 5 depict two-piece embodiments. In preferred embodiments, upper face 14 and lower face 26 are permanently affixed to cylindrical side 18. Those skilled in the art will recognize a variety of methods for permanently affixing upper face 14 and lower face 26 to cylindrical side 18. Alternatively, upper face 14 and/or lower face 26 may be removably attached to cylindrical side 18 such that the means disposed within the cavity may be modified or replaced. Those skilled in the art will recognize a variety of methods for removably attaching upper face 14 and lower face 26 to cylindrical side 18. Representative methods for permanently and/or removably affixing faces 14 and 26 to body 12 include gluing, welding, threading, and snap-fit interlocking.

Figure 6:
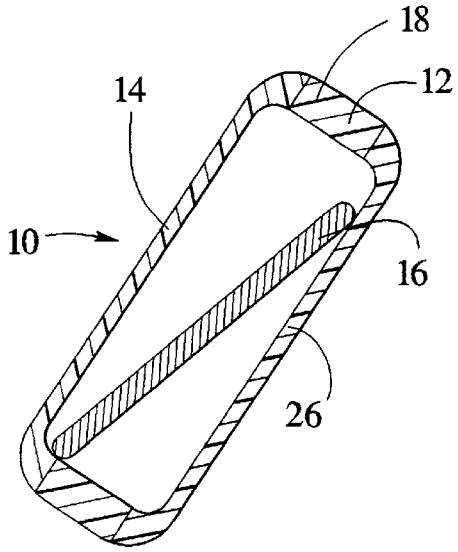
FIG. 6 is a sectional view of the hockey puck of FIG. 2 showing the weight forming an angle with respect to the faces.

The means for causing the puck to topple or for maintaining the face of the puck parallel to the playing surface preferably comprises a single weight 16, though a plurality of weights may also be employed in the inventive puck. Weight 16 preferably comprises a disc having a central axis disposed within the cavity such that the weight is free to move in the cavity, i.e., the weight may move both parallel and perpendicular to the faces As can be seen from FIG. 6, this freedom of movement of weight 16 permits the central axis of the weight 16 to form an angle with the faces 14 and 26. Preferably, the weight 16 has sufficient freedom of movement within the cavity to permit the central axis of the weight 16 to become angularly offset from normal to the plane of the faces 14 and 26 by at least 30°. Thus, the center of mass of weight 16 may move within a predetermined volume within the cavity such that the center of mass of the puck is variable in three dimensions in the cavity. The predetermined volume is a function of several variables, including the diameter of weight 16 and the distance between faces 14 and 26.

Weight 16 is preferably a single weight comprised of any suitable weighting material, including, for example, various metals such as lead or steel, composite materials or polymers. Weight 16 may be coated with any suitable coating material such as, for example, paints, polymers, or metals. Thus, by creating a variable center of mass, the weight having freedom to move within the cavity causes the puck to more readily topple when rolling on its side or corner and tends to maintain the puck in a position substantially parallel to the playing surface.

Figure 7A:
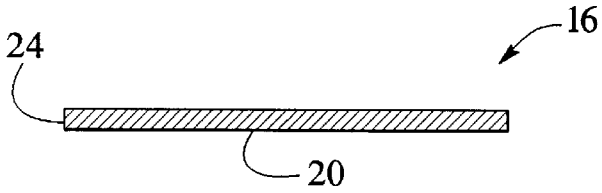
FIG. 7A is a sectional view of a square-cornered weight in accordance with the invention.
Figure 7B:
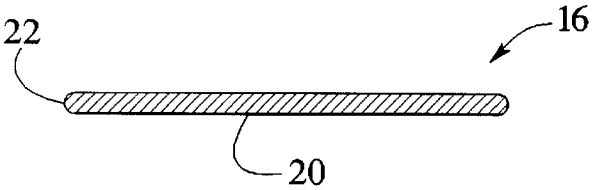
FIG. 7B is a sectional view of a round-cornered weight in accordance with the invention.

In the preferred embodiments, the weights have a greater diameter than height. Further, these weights are of a diameter that is less than the diameter of the cavity defined by the cylindrical side 18, upper face 14 and lower face 26. As shown in FIG. 7, weight 16 may have a rounded edge 22 or a squared edge 24. In preferred embodiments, the edges of weight 16 are rounded.

Weight 16 may be of a weight sufficient to provide the hockey puck 10 with a total weight of about 170 g. Such a weight would range from 10 g to 170 g. In preferred embodiments, the diameter of weight 16 is greater than one-half the diameter of the cavity, but still less than the diameter of the cavity. Further, the height of the weight 16 is less than half the distance from upper face 14 to lower face 26. Preferably, the weight 16 ranges from about 1.5 to 2.75 inches in diameter, from about 0.0625 to 0.5 inches in height, and from about 1 to 3 ounces. However, hockey puck 10 and weight 16 may be manufactured to be of any desired or suitable sizes.

Figure 8:
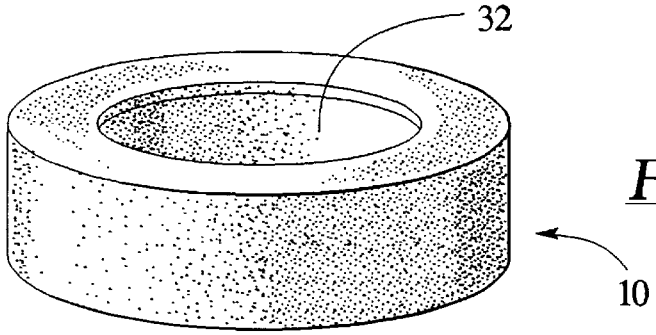
FIG. 8 is a perspective view of a hockey puck according to the invention, having a face of the puck defining an aperture

In certain embodiments, upper face 14 and/or lower face 26 may define an aperture 32, as shown in FIG. 8, the aperture 32 having a diameter less than the diameter of the weight 16.

When at rest, the inventive hockey puck has its center of gravity at a position below the geometric center of the puck. The low center of gravity causes the puck to resist rising up on its edge while sliding on the playing surface or after being "shot." Hockey pucks according to the invention thus include a self-leveling means The self-leveling means, disposed within the cavity, provides a hockey puck that is resistant to rising from a face to its edge or side upon interaction with irregularities in the playing surface. Further, the self-leveling means provides a hockey puck that has a tendency to topple from the side once rolling, after an interaction with a playing surface irregularity.

From the foregoing it will be appreciated that, although specific embodiments of the invention have been described herein for purposes of illustration, various modifications may be made without deviating from the spirit and scope of the invention.

What is claimed is:

1. A street hockey puck comprising (a) a cylindrical body having a side, an upper face and a lower face substantially parallel to said upper face, said side, and lower face defining a cavity; and (b) a weight disposed within said cavity, said weight having at least one linear dimension greater than the distance between substantially parallel faces, and said weight being substantially movable in three dimensions relative to the cavity, such that the weight is free to move within the cavity both parallel and perpendicular to the faces, and having sufficient freedom of movement to permit the weight to permit the central axis of the weight to become angularly offset from normal to the faces and to permit the weight to simultaneously contact both faces so that that puck will more readily topple when rolling on its side.

2. A street hockey puck comprising (a) a cylindrical body having a side, an upper face and a lower face substantially parallel to said upper face, said side, upper face and lower face defining a cavity; and a weight disposed within said cavity, said weight having at least one linear dimension greater than the distance between substantially parallel faces, and said weight being substantially movable in three dimensions relative to the cavity, such that the weight is free to move within the cavity both parallel and perpendicular to the faces, and having sufficient freedom of movement to permit the weight to permit the central axis of the weight to become angularly offset from normal to the faces and to permit the weight to simultaneously contact both faces so that that puck will more readily topple when rolling on its side.

3. A hockey puck according to claim 2, wherein the diameter of the weight is greater than one-half the greatest linear dimension of the cavity.

4. A hockey puck according to claim 3, wherein the height of the weight is less than one-half the distance from the upper face to the lower face.

5. A hockey puck according to claim 4, wherein each of the upper and lower face defines an aperture, the aperture having a diameter less than the diameter of the weight.

6. A hockey puck according to claim 5, wherein the weight comprises a material selected from the group consisting of metals, composite materials and polymers.

7. A hockey puck according to claim 6, wherein the weight weighs from about 10 g to 170 g.

8. A street hockey puck resistant to rising from a face to its edge upon interaction with playing surface irregularities comprising (a) a cylindrical body having a side, an upper face and a lower face substantially parallel to said upper face, said side, upper face and lower face defining a cavity, and (b) a weight for maintaining a face of the puck substantially parallel to the playing surface, said weight disposed within said cavity, said weight having one linear dimension greater than the distance between said substantially parallel faces, and said weight being substantially movable in three dimensions relative to the cavity, such that the weight is free to move within the cavity both parallel and perpendicular to the faces, and having sufficient freedom of movement to permit the central axis of the weight to become angularly offset from normal to the faces and to permit the weight to simultaneously contact both faces so that the puck will more readily topple when rolling on its side.

9. A hockey puck according to claim 8, wherein the weight is a cylinder having a height, and a diameter greater than the height, and the longitudinal axis of the weight is capable of forming a variable angle with the faces.

10. A hockey puck according to claim 9, wherein the diameter of the weight is greater than one-half the greatest linear dimension of the cavity.

11. A hockey puck according to claim 9, wherein the height of the weight is less than one-half the distance from the upper face to the lower face.

12. A hockey puck according to claim 9, wherein each of the upper and lower face defines an aperture, the aperture having a diameter less than the diameter of the weight.

13. A hockey puck according to claim 8, wherein the weight comprises a material selected from the group consisting of metals, composite materials and polymers.

14. A hockey puck according to claim 8, wherein the weight weighs from about 10 g to 170 g.

15. A hockey puck according to claim 8, wherein the cylindrical body, upper face and lower face are comprised of a polymeric material.

16. A process for manufacturing a hockey puck resistant to rising from a face to its edge upon interaction with playing surface irregularities comprising (a) forming a cylindrical body having a side, an upper face and a lower face substantially parallel to said upper face, said upper face and lower face being permanently affixed to said side, said side, upper face and lower face defining a cavity, and (b) providing within the cavity a weight for maintaining a face of the puck substantially parallel to the playing surface, said weight disposed within said cavity, said weight having one linear dimension greater than the distance between said substantially parallel faces, and said weight being substantially movable in three dimensions relative to the cavity, such that the weight is free to move within the cavity both parallel and perpendicular to the faces, and having sufficient freedom of movement to permit the weight to permit the central axis of the weight to become angularly offset from normal to the faces and to permit the weight to simultaneously contact both of the faces so that the puck will more readily topple when rolling on its side.

* * * * *